US011497358B2

(12) United States Patent
Fovell

(10) Patent No.: US 11,497,358 B2
(45) Date of Patent: Nov. 15, 2022

(54) RECHARGEABLE ANTIMICROBIAL WIPE SYSTEM

(71) Applicant: CK Product Development, LLC, Corona, CA (US)

(72) Inventor: Jack Fovell, Corona, CA (US)

(73) Assignee: CK Product Development, LLC, Corona, CA (US)

( * ) Notice: Subject to any disclaimer, the term of this patent is extended or adjusted under 35 U.S.C. 154(b) by 216 days.

(21) Appl. No.: 16/885,012

(22) Filed: May 27, 2020

(65) Prior Publication Data

US 2021/0369060 A1 Dec. 2, 2021

(51) Int. Cl.
*A47K 10/28* (2006.01)
*A47K 10/46* (2006.01)
*A47K 10/32* (2006.01)

(52) U.S. Cl.
CPC ..... *A47K 10/28* (2013.01); *A47K 10/46* (2013.01); *A47K 2010/328* (2013.01)

(58) Field of Classification Search
CPC ... A47K 10/28; A47K 10/46; A47K 2010/328
USPC ..... 68/13 R
See application file for complete search history.

(56) References Cited

U.S. PATENT DOCUMENTS 5,887,759 A * 3/1999 Ayigbe ..... A47K 10/32 118/325
6,708,845 B2 * 3/2004 Weng ..... A47K 10/32 222/61
6,902,077 B1 * 6/2005 Tack ..... A47K 10/421 220/254.1
8,181,284 B1 * 5/2012 Parker ..... B60R 15/04 4/301
9,532,684 B2 * 1/2017 Hoefte ..... A47K 10/3836
10,064,525 B2 * 9/2018 Ader ..... A47K 10/42
10,555,521 B2 * 2/2020 Joshi ..... A61L 2/0047
11,000,163 B2 * 5/2021 Shanahan ..... A47K 10/3687
11,278,636 B2 * 3/2022 Claussner ..... A47L 13/51
(Continued)

FOREIGN PATENT DOCUMENTS

CA 2805419 A1 * 1/2012 ..... A47K 10/24
WO WO-03051764 A1 * 6/2003 ..... A47K 10/32
(Continued)

*Primary Examiner* — Stephen M Gravini
(74) *Attorney, Agent, or Firm* — Knobbe, Martens, Olson & Bear, LLP

(57) ABSTRACT

Various rechargeable antimicrobial wipe systems are disclosed. The rechargeable antimicrobial wipe system can include a reusable cloth configured to receive antimicrobial fluid, a canister, and a dispenser. The canister can comprise a distal end, a proximal end, and an intermediate portion. The distal end can comprise an access opening and a lid configured to be opened and closed. The intermediate portion can comprise an internal chamber configured to receive the cloth via the access opening and an antimicrobial fluid via an opening in the proximal end of the canister. The dispenser can be configured to deliver the fluid to the internal chamber of the canister. A distal portion of the dispenser can comprise an opening. The distal portion can be configured to engage with the opening of the proximal end of the canister. A body portion of the dispenser can comprise a reservoir of the fluid.

20 Claims, 6 Drawing Sheets

(56) References Cited

U.S. PATENT DOCUMENTS

| | | | | |
|---|---|---|---|---|
| 2009/0031952 | A1* | 2/2009 | Lazar | A47K 10/32 118/695 |
| 2009/0032636 | A1* | 2/2009 | Orlandi | A47K 10/32 242/560.1 |
| 2019/0343974 | A1* | 11/2019 | Jin | A61Q 19/10 |
| 2020/0154957 | A1* | 5/2020 | Abraham | A47K 10/3643 |
| 2021/0153700 | A1* | 5/2021 | McCarthy | A47K 10/26 |
| 2021/0321834 | A1* | 10/2021 | Jennings | A47K 10/46 |
| 2021/0361125 | A1* | 11/2021 | Racioppi | A47K 17/00 |
| 2021/0369060 | A1* | 12/2021 | Fovell | A47K 10/28 |
| 2021/0370345 | A1* | 12/2021 | Fovell | A47L 13/16 |

FOREIGN PATENT DOCUMENTS

| | | | | |
|---|---|---|---|---|
| WO | WO-2007105208 | A3 * | 4/2009 | A47K 10/32 |
| WO | WO-2015106044 | A1 * | 7/2015 | A47K 10/38 |

* cited by examiner

RECHARGEABLE ANTIMICROBIAL WIPE SYSTEM

BACKGROUND

Field

The present disclosure generally relates to rechargeable antimicrobial wipe systems that are configured to store and/or deliver an antimicrobial fluid to a cloth or other wiping device. For example, the system may comprise an internal chamber that receives the cloth on one end and the antimicrobial fluid from a dispenser on the other end.

Description of Certain Related Art

It is important to maintain the cleanliness of a person's surroundings. Many people have access to a wide variety of cleaning products and tools for keeping their homes clean. However, it is more difficult to control the cleanliness of public places. The variety of cleaning products and tools are not easy to carry around in public spaces because they are often big and bulky (e.g., bottles of cleaning solutions, rolls of paper towels). Many of the products that are more portable can produce a large amount of waste.

SUMMARY OF CERTAIN FEATURES

Keeping a person's environment clean can help decrease the likelihood of becoming sick or infected with a virus, bacteria, or other microorganism. Cleaning supplies (such as cleaning solutions) often come in large containers, like a large spray bottle. Other supplies, such as paper towels, can themselves be large and bulky. More portable solutions, like portable wipes, can produce an undesirable amount of waste because these portable wipes are single use items. After the single use, the wipe is intended to be discarded. Even if the wipe were to be reused, the wipe would lose its effectiveness as the cleaning agent in the wipe would be exhausted or at least reduced.

It would be beneficial to have an antimicrobial wipe system that includes reusable antimicrobial cloth. This would reduce waste. Additionally, it would reduce or avoid the inconvenience of running out of wipes at an inopportune time, such as when the user is traveling away from home. It would also be beneficial to replenish the reusable cloth with antimicrobial fluid. This would allow the cloth to maintain effectiveness for multiple uses. It would further be beneficial for the antimicrobial agent to be readily changeable. For example, to allow the agent to be changed based on a desired level of cleanliness, active or inactive ingredients, scent, or otherwise. This could allow the user to select an antimicrobial agent for use in a particular environment. For example, when going to a place that the user classifies as relatively less clean, the user may select an agent with more cleaning power (which might be harsher on skin or other surfaces), and when going to a place that the user classifies as relatively more clean, the user may select an agent with less cleaning power (which might be less abrasive to skin or other surfaces).

As an example, a user may carry the system (e.g., on a key ring) to a store. The system can include the reusable cloth, a canister device, and a dispenser containing antimicrobial fluid. The user inserts the reusable cloth into the canister device and actives the dispenser, thereby dispensing (e.g., spraying) the reusable cloth with antimicrobial fluid. Prior to touching a public surface (e.g., grabbing a shopping cart handle), the user can remove the cloth from the canister device and use the cloth to clean the surface. The user can insert the cloth back into the canister device and spray the cloth with more antimicrobial fluid. The cloth is thus recharged (e.g., refilled, renewed, refreshed, etc.) and ready for use to clean other surfaces.

The rechargeable antimicrobial wipe system disclosed herein address one or more of the above concerns, or other concerns.

In some aspects of the disclosure, a rechargeable antimicrobial wipe system is disclosed. The antimicrobial wipe system may comprise a reusable cloth, a canister, and a lid. The reusable cloth may be configured to receive antimicrobial fluid. The canister can comprise a distal end, a proximal end, and an intermediate portion. The distal end of the canister may comprise an access opening and a lid. The lid may be configured to be opened and closed. The proximal end of the canister may comprise an opening through the proximal end. The intermediate portion of the canister may comprise an internal chamber configured to receive the cloth. The dispenser may be configured to deliver antimicrobial fluid into the internal chamber of the canister. The dispenser may comprise a distal portion and a body portion. The distal portion of the dispenser may comprise an opening. The distal portion of the dispenser may be configured to engage with the opening of the proximal end of the canister. The body portion of the dispenser may comprise a reservoir of the antimicrobial fluid.

The rechargeable antimicrobial wipe system can include one or more of the following features. The fluid can comprise a sanitizing fluid. The cloth can comprise a fibrous material. The access opening of the canister can comprise a threaded portion on an external face of the access opening. The lid can comprise a threaded portion on an internal face. The threaded portion of the access opening of the canister can be configured to engage with the threaded portion of the lid such that the lid seals the access opening of the canister. The lid can comprise a flip cap. The dispenser can comprise an aerolizer and/or a propellant. The internal chamber can comprise a generally cylindrical shape. The proximal end of the canister can further comprise a threaded adapter. The distal portion of the dispenser can be configured to mate with the threaded adapter. The system can further comprise a pump mechanism configured to pump the antimicrobial fluid from the reservoir of the body portion of the dispenser through the opening of the distal portion of the dispenser and into the internal chamber of the canister.

In some aspects, a kit is disclosed. The kit may comprise the antimicrobial wipe system and at least one or more of the reusable cloth.

In some aspects, an apparatus for delivering antimicrobial fluid to a reusable cloth is disclosed. The apparatus may comprise a canister, and a dispenser. The canister may comprise a distal end, a proximal end, and an intermediate portion. The distal end of the canister may comprise an access opening and a lid that is configured to be opened and closed. The access opening may be configured to allow the cloth to pass thorough the access opening. The proximal end of the canister may comprise threads and an opening extending through the proximal end. The intermediate portion of the canister may comprise an internal chamber configured to receive the cloth and the antimicrobial fluid. The dispenser may comprising a distal portion and a body portion. The dispenser may be configured to deliver the antimicrobial fluid to the internal chamber of the canister. The distal portion of the dispenser may comprise an opening and a threaded portion. The opening of the dispenser may be configured to deliver the antimicrobial fluid to the internal chamber of the canister. The threaded portion of the dispenser may be configured to engage with the threads and opening of the distal end of the canister such that the distal portion of the dispenser is secured to the proximal end of the canister. The body portion of the dispenser may comprise a reservoir of the antimicrobial fluid. The body portion may comprise a flexible sidewall. The body portion may be configured to eject the antimicrobial fluid through the opening of the dispenser and into the internal chamber of the canister when a user squeezes the flexible sidewall of the dispenser.

The apparatus can include one or more of the following features. The access opening of the canister can comprise a threaded portion on an external face of the access opening. The lid can comprise a threaded portion on an internal face. The threaded portion of the access opening of the canister can be configured to engage with the threaded portion of the lid such that the lid seals the access opening of the canister. The lid can comprise a flip cap. The dispenser can comprise an aerolizer or a propellant. The canister can comprise a generally cylindrical shape. The apparatus can further comprise one or more reusable cloths.

In some aspects, an antimicrobial wipe system is disclosed. The system may comprise a canister, a dispenser and a cloth. The canister may have a first opening and a second opening. The dispenser may have an opening. The cloth may be placed in the canister through the first opening of the canister. The second opening of the canister may be in fluid communication with the opening in the dispenser. A fluid may be transferred from the dispenser to the canister to provide disinfectant to the cloth in the canister.

For purposes of summarizing the disclosure, certain aspects, advantages, and features of the technology have been described herein. Not necessarily any or all such advantages are achieved in accordance with any particular embodiment of the technology disclosed herein. No aspects of this disclosure are essential or indispensable. Neither the preceding summary nor the following detailed description purports to limit or define the scope of protection. The scope of protection is defined by the claims.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments.

DETAILED DESCRIPTION OF CERTAIN EMBODIMENTS

Reference will now be made in detail to various embodiments of the present technology, which relates to a rechargeable antimicrobial wipe system. Although certain specific embodiments of the present technology are described, the present technology is not limited to these embodiments. On the contrary, these described embodiments are merely illustrative of the present technology, and the present technology is intended to also cover alternatives, modifications, and equivalents. Furthermore, in the following detailed description, numerous specific details are set forth in order to provide a thorough understanding of the present technology. However, it will be recognized by one of ordinary skill in the art that embodiments can be practiced without these specific details. In some instances, well-known methods, procedures, compounds, compositions and mechanisms have not been described in detail as not to unnecessarily obscure aspects of embodiments of the present technology.

Figure 1:
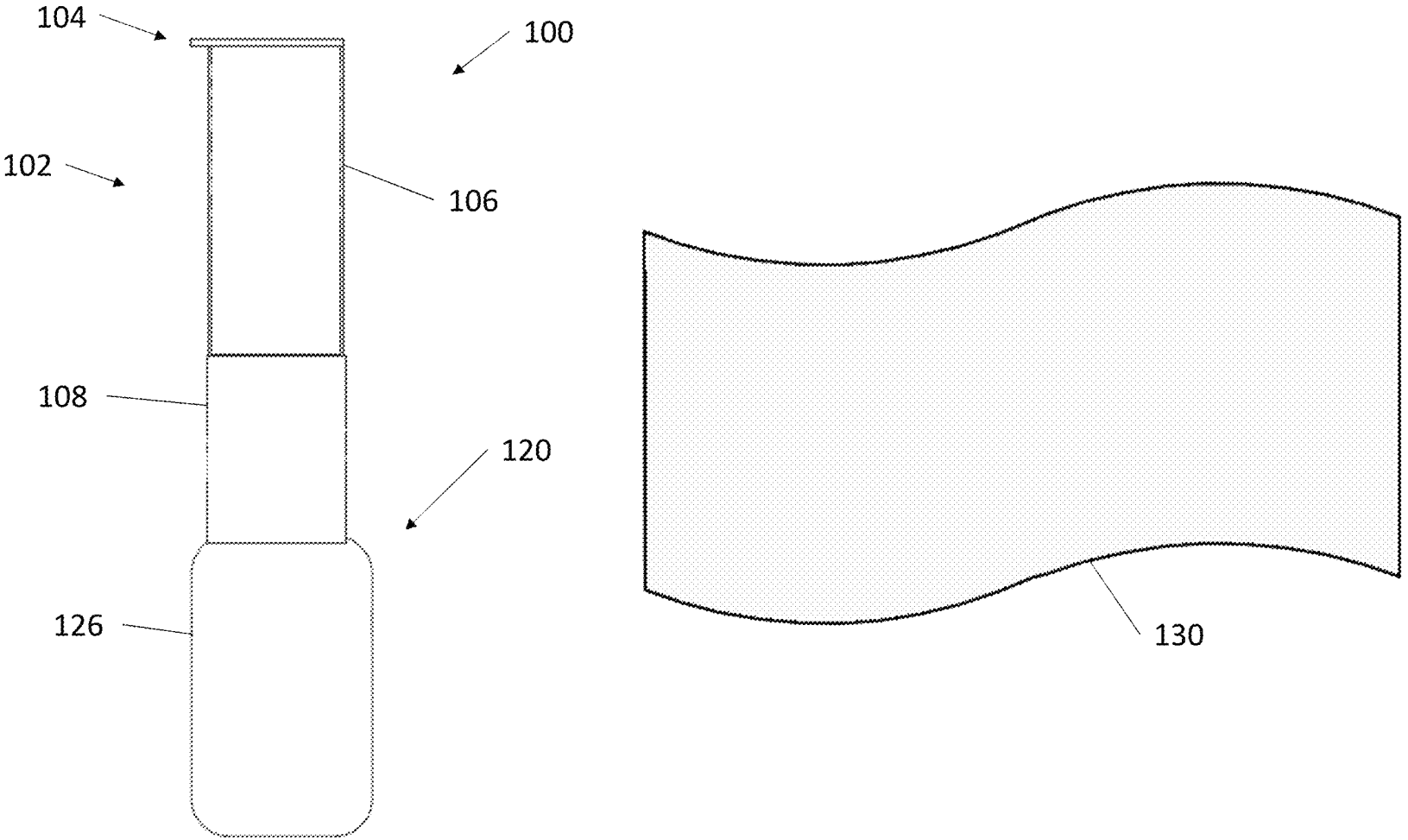
FIG. 1 shows a side view of an embodiment of a rechargeable antimicrobial wipe system.

FIGS. 1-4B illustrate an embodiment of a rechargeable antimicrobial wipe system 100. As shown in FIG. 1, the system 100 can include a fluid dispenser 120 and a canister or receptacle 102. In some implementations, the system includes a reusable cloth 130. The canister 102 may comprise a distal end 104, an intermediate portion 106, and a proximal portion 108 (also called a proximal end). The canister 102 can removably connect to the fluid dispenser 120, such as with a threaded connection, a snap-fit engagement, detent, or other coupling mechanism. As described in more detail below, the fluid dispenser 120 can dispense antimicrobial fluid into the canister 102, which can hold the cloth 130.

Figure 2B:
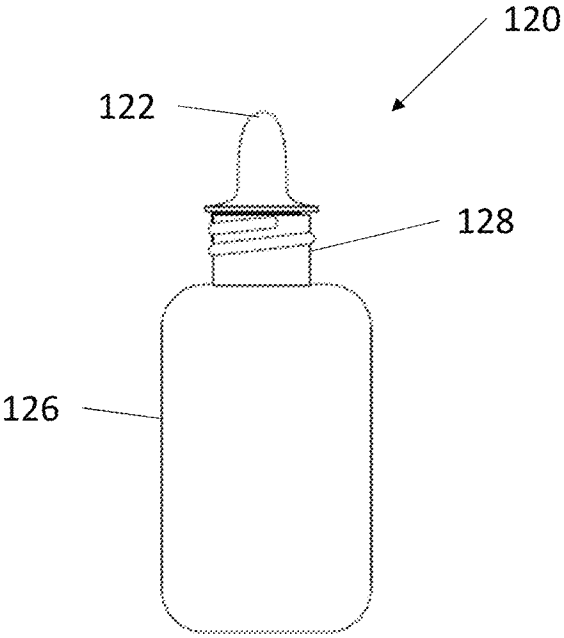
FIGS. 2A-2B show side views of embodiments of a fluid dispenser of the system of FIG. 1.
Figure 2A:
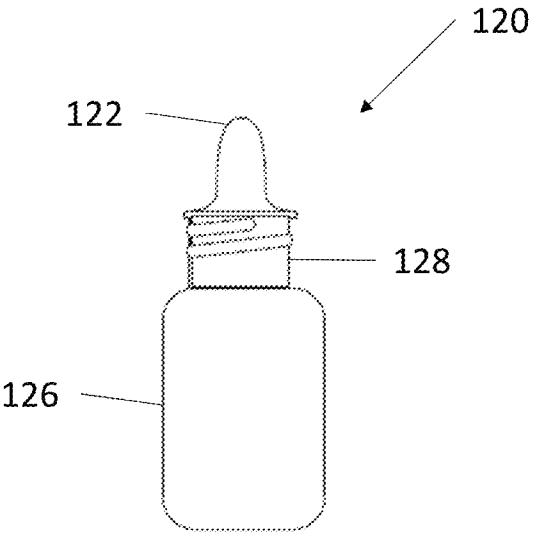
Figure 4A:
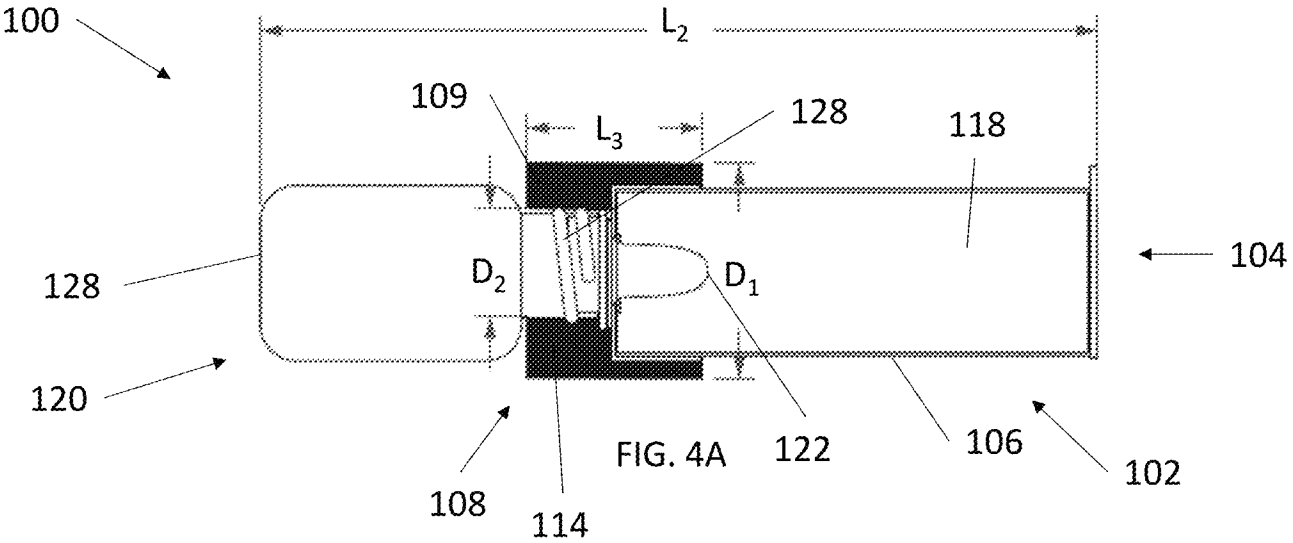
FIGS. 4A-4B show partial cross-sectional views of examples of the dispenser and canister of the system.
Figure 4B:
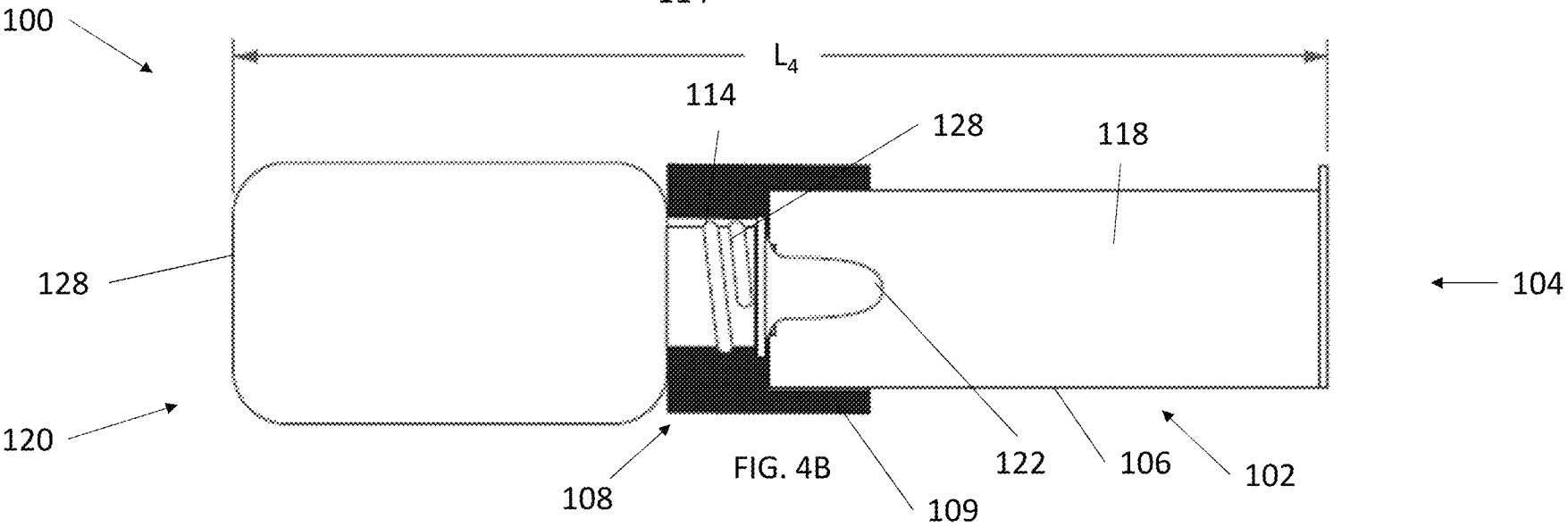

As shown in FIGS. 2A-2B, the dispenser 120 can comprise a distal end 122 and a body portion 126. The dispenser 120 can have many sizes. For example, views of a smaller size of the dispenser 120 are shown in FIGS. 2A and 4A, and views of a larger size of the dispenser 120 are shown in FIGS. 2B and 4B. In some embodiments, the body portion 126 of the dispenser may have a length of at least about 20 millimeters and/or less than or equal to about 80 millimeters. In some variants, the body portion 126 has a width (e.g., diameter) of at least about 10 millimeters and/or less than or equal to about 31 millimeters. In certain variants, the body portion 126 of the dispenser 120 may have a length of at least about 60 millimeters and/or less than or equal to at least about 100 millimeters and a width or diameter of at least about 20 millimeters and/or less than or equal to at least about 40 millimeters. Although specific dimensions are described, other lengths and widths of the body portion 126 are contemplated and are within the scope of the present invention.

In some embodiments, the body portion 126 comprises a generally cylindrical shape. Other shapes are contemplated as well, such as a cross sectional shape that is triangular, rectangular, square, hexagonal, octagonal, etc. Non-geometric shapes are also contemplated, such as a shape of an animal (e.g., a dog, a cat), a star, or a car.

The body portion 126 can comprise an inner reservoir for storing an antimicrobial fluid. The antimicrobial fluid can be a bactericide, virucide, or other compound that destroys or deactivates microorganisms. The antimicrobial fluid can be a sanitizing and/or disinfecting fluid. In some embodiments, the antimicrobial fluid comprises a bleach-based fluid, alcohol-based fluid (e.g., with at least about 70% alcohol), etc. In some aspects, the small dispenser may be configured to hold at least about 1 oz. of an antimicrobial fluid, or any other fluid. In some aspects, the dispenser 120 may be configured to hold at least about 2 oz. of an antimicrobial fluid, or any other fluid.

Figure 3:
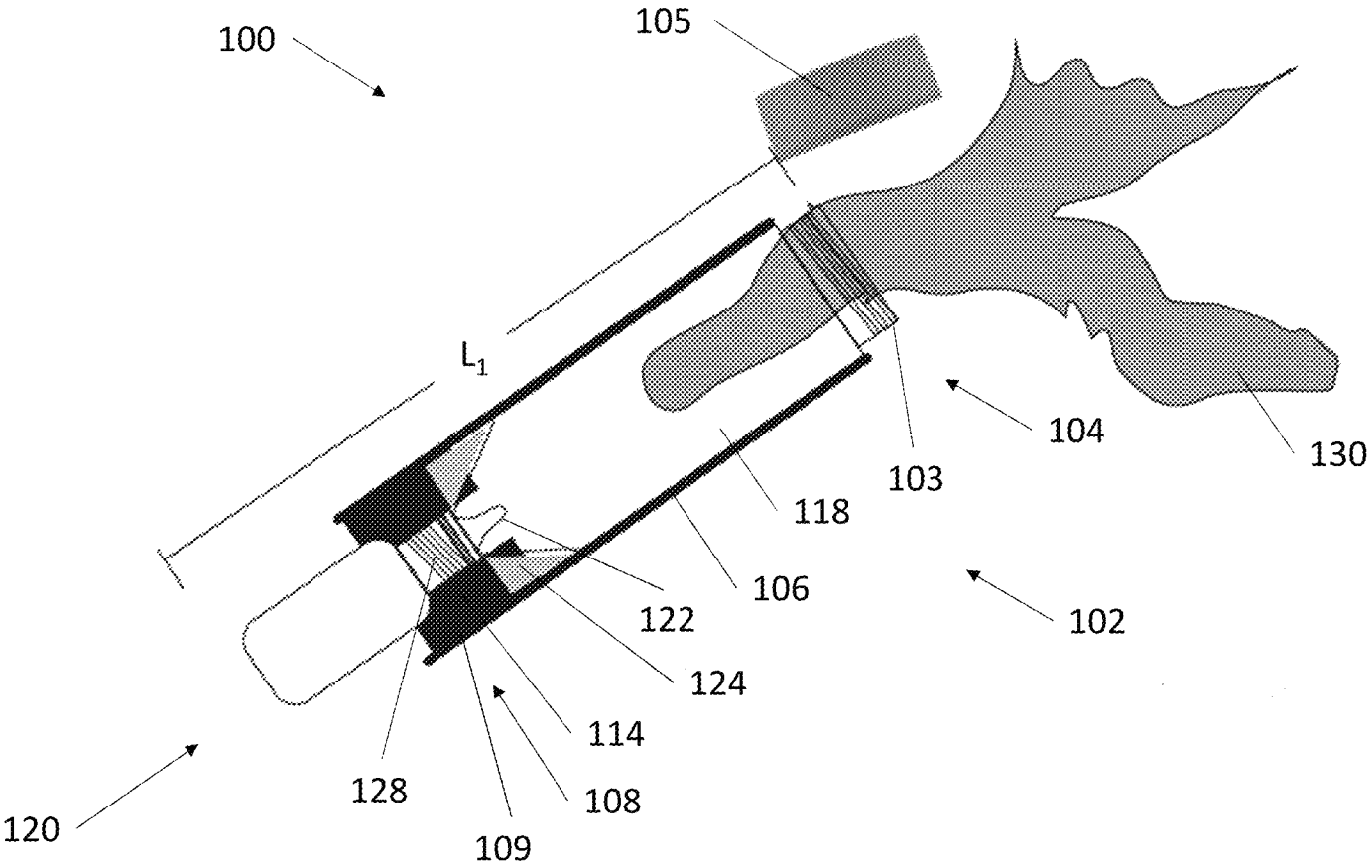
FIG. 3 shows a partial cross-sectional view of the system of FIG. 1, with the dispenser being connected to a canister, and the canister partially receiving a cloth.

As shown in FIG. 3, the dispenser 120 can be configured to removably connect to the canister 102. For example, the distal end 122 of the dispenser 120 can couple to the canister 102. In some embodiments, the dispenser 120 can include a threaded connection, such as a threaded portion 128 between the distal end 122 and body portion 126. In some embodiments, the distal end 122 includes the threaded portion 128. The threaded portion 128 can be configured to engage with the canister 102 such that the distal end 122 of the dispenser is secured and/or sealed to the canister 102, as described in greater detail below with reference to FIGS. 3-4B. In various embodiments, the dispenser 120 and canister 102 are removably secured to each other. For example, the dispenser 120 and canister 102 can be removably connected with a snap fit, bayonet connector, detent, or other connection mechanism.

The dispenser 120 can include an opening through which the dispenser 120 delivers the fluid to the canister 102. The opening can be on the distal end 122. The opening can be in fluid communication with an inner chamber 118 of the canister 102.

The dispenser 120 may be configured to eject the antimicrobial fluid from the inner reservoir, through the opening, and into the canister 102. In some aspects, the dispenser 120 may be configured to eject (e.g., spray) the fluid in a direction generally parallel to a longitudinal axis of the canister 102. In certain embodiments, the dispenser 120 dispenses the fluid as an aerosol, such as a mist. In some variants, the dispenser 120 dispenses the fluid as a liquid. Certain implementations dispense a combination of aerosolized fluid and liquid. The dispenser 120 may be a dropper bottle, an aerolizer, a mist pump sprayer, or any container that is configured to eject a fluid from the inner reservoir and into the canister 102. The dispenser 120 can comprise different pump mechanisms to eject the antimicrobial fluid from the inner reservoir into the canister 102. For example, the body portion 126 can comprise flexible walls such that a user may squeeze the body portion 126 to eject the fluid into the internal chamber 118, as described in more detail below. As another example, the pump mechanism of the dispenser 120 can include pressurizing the fluid, like an aerosol can, and engaging with a mechanism (e.g., a button, a switch) on the dispenser 120 to release the fluid into the internal chamber 118. In some variants, the pump mechanism of the dispenser 120 can include a button, a switch, or other mechanism that a user can pull, depress, or actuate to deliver the fluid into the internal chamber 118.

As mentioned above, the rechargeable antimicrobial wipe system 100 can include the canister 102, as shown in FIGS. 1 and 3-4B. The canister 102 may comprise the distal end 104, intermediate portion 106, and proximal portion 108. The distal end 104 can comprise an access opening 103, such as a through hole. The distal end 104 can have a sealing member, such as a lid 105, which can seal the access opening 103. The lid 105 can be configured to be opened and closed. For example, the lid 105 can comprise a flip cap or a hinged snap lid that is connected to the distal end 104 of the canister 102. As another example, the distal end 104 can comprise threads (e.g., on an outer surface of the access opening 103) and the lid 105 can comprise a removable cap with mating threads (e.g., on an internal surface of the lid 105). A user may thread the removable cap to the distal end 104 of the canister 102 (thereby closing and/or sealing the distal end 104 of the canister 102) and/or unthread the removable cap (thereby opening the distal end 104 of the canister). In that case, the cap 105 may be tethered to the canister 102 to prevent a user from losing the cap 105.

As shown in FIG. 3, the access opening 103 at the distal end 104 of the canister 102 can be configured to receive an object. For example, the access opening 103 can be large enough for a user to insert a cloth 130 (e.g., a microfiber cloth or any fibrous cloth). In some aspects, the intermediate portion 106 is located between the distal end 104 and the proximal portion 108. The intermediate portion 106 may comprise the inner chamber 118 that is configured to receive a cloth. For example, the cloth 130 may be completely received in the inner chamber 118 and the lid 105 can be closed.

In some embodiments, the intermediate portion 106 can comprise a generally hollow and/or generally round (e.g., cylindrical) shape. Other shapes are contemplated as well, such as a cross sectional shape that is triangular, rectangular, square, hexagonal, octagonal, etc. Non-geometric shapes are also contemplated, such as a shape of an animal (e.g., a dog, a cat), a star, or a car.

The cloth 130 can be configured to be reusable. In some aspects, the cloth 130 can be configured to be washable such that the user may wash the cloth 130 by hand or by machine after the user has used the cloth 130 a desired amount. In some variants, the cloth 130 can comprise a woven or non-woven material. The cloth 130 can comprise a microfiber cloth, a cotton-based cloth, or any material configured to be reusable and able to retain a fluid. In some aspects, the cloth 130 can comprise a height of about 3 inches to about 12 inches, about 5 inches to about 10 inches, or about 7 inches to about 8 inches. In some aspects, the cloth 130 can comprise a width of about 3 inches to about 12 inches, about 5 inches to about 10 inches, or about 7 inches to about 8 inches. Although specific dimensions are described, other heights and widths of the cloth 130 are contemplated and are within the scope of the present invention.

As shown in FIGS. 3-4B, the canister 102 can be configured to removably connect with the dispenser 120. For example, the proximal portion 108 of the canister 102 can be configured to removably connect with the distal end 122 of the dispenser 120. In some embodiments, the proximal portion 108 comprises a threaded adapter 109. The threaded adapter 109 may comprise a threaded opening 114 that extends through at least a portion of the length of the threaded adapter 109. The threaded opening 114 can be configured to engage with the threaded portion 128 of the dispenser 120 such that the distal end 122 of the dispenser 120 is sealed and/or secured to the threaded adapter 109. For example, the threaded portion 128 and the threaded opening 114 may comprise a 20/410 threading. The threaded portion 128 and the threaded opening 114 may comprise any threading size suitable for removably securing the distal end 122 of the dispenser 120 to the threaded adapter 109. Although the figures illustrate the threaded opening 114 being a female connector and the distal end 122 of the dispenser 120 being a male connector, the threaded opening 114 can comprise a male connector configured to engage with a female connector of the distal end 122 of the dispenser 120. In some variants, the distal end of the canister 102 and the proximal end of the dispenser 120 are reversed and/or use a different configuration to mate.

As shown in FIG. 4A, the threaded opening 114 may have a diameter $D_2$ that aligns with the diameter of the threaded portion 128 of the dispenser 120. In some aspects, the diameter $D_2$ can be about 19 millimeters. In some aspects, the diameter $D_2$ can be about 10 millimeters to about 40 millimeters, about 15 millimeters to about 35 millimeters, or about 20 millimeters to about 30 millimeters. Although specific diameters are described, other diameters of the threaded opening 114 are contemplated and are within the scope of the present invention.

In some embodiments, the proximal portion 108 (e.g., the threaded adapter 109) is integral with and/or unitarily formed with the intermediate portion 106. In certain variants, the threaded adapter 109 is a separate component from the intermediate portion 106, such as being separately molded or otherwise formed. The threaded adapter 109 can be configured to connect to the intermediate portion 106. In some aspects, the threaded adapter 109 may include a recess that is configured to receive a proximal end of the intermediate portion 106. The intermediate portion 106 may be glued, welded, or otherwise attached to the threaded adapter 109. In some embodiments, the intermediate portion 106 and the threaded adapter 109 are manufactured as a unitary piece. In some embodiments, as shown in FIG. 3, the threaded adapter 109 may include silicone adhesive 124 that adheres to the inner surface of the intermediate portion 106.

As shown in FIGS. 4A and 4B, in some aspects, the threaded adapter 109 comprises a length $L_3$ and an outer diameter $D_1$. In some aspects, the length $L_3$ of the threaded adapter 109 can be about 31 millimeters. In some aspects, the length $L_3$ of the threaded adapter 109 can be about 20 millimeters to about 40 millimeters or about 25 millimeters to about 35 millimeters. In some aspects, the outer diameter $D_1$ of the threaded adapter 109 can be approximately 38 millimeters. In some aspects, the outer diameter $D_1$ of the threaded adapter 109 can be about 25 millimeters to about 45 millimeters or about 30 millimeters to about 40 millimeters. Although specific lengths and outer diameters are described, other lengths and outer diameters of the threaded adapter 109 are contemplated and are within the scope of the present invention.

In some aspects, the canister 102 can have a width or diameter of about 30 millimeters and a length of about 85 millimeters. In some aspects, the canister 102 can have a width/diameter of about 10 to 50 millimeters, about 15 millimeters to about 45 millimeters, about 20 millimeters to about 40 millimeters, or about 25 millimeters to about 35 millimeters. In some aspects, the canister 102 can have a length of about 50 millimeters to about 120 millimeters, about 60 millimeters to about 110 millimeters, about 70 millimeters to about 100 millimeters, or about 80 millimeters to about 90 millimeters. Although specific widths/diameters are described, other widths/diameters of the canister 102 are contemplated and are within the scope of the present invention.

In some embodiments, the diameter of the canister 102 can be the same or substantially the same as the diameter/width of the dispenser 120 such that the system 100 forms a contiguous shape (e.g., a cylindrical shape) when the canister 102 and the dispenser 120 are connected.

The rechargeable antimicrobial wipe system 100 can be readily portable. In some embodiments, the rechargeable antimicrobial wipe system 100 is configured to be carried on a key ring, a carabineer, or the like. For example, the canister 102 may comprise an external loop on an external face. A user could attach the external loop to a key ring, a carabineer, or the like so that it is easier for the user to carry the canister 102 with them. Various embodiments of the rechargeable antimicrobial wipe system 100 are configured to fit inside a purse or handbag, in a shirt or pants pocket, pen or pencil case, or other small portable volume or device.

The rechargeable antimicrobial wipe system 100 is useful in many situations. For example, a user may use the system 100 to apply (e.g., infuse, saturate, etc.) the cloth with the antimicrobial fluid. The user can connect the dispenser 120 with the canister 102. For example, in some embodiments, the connection is achieved by threading the distal end 122 of the dispenser 120 to the threaded opening 114 of the threaded adapter 109. The user can open (e.g., remove) the lid 105 of the canister 102, such as is shown in FIG. 3. The user can insert the cloth 130 through the access opening 103 and into the internal chamber 118 of the intermediate portion 106. The user can secure the lid 105 to the access opening 103, such as by snapping or screwing the lid 105 closed. The user can actuate the dispenser 120 such that the antimicrobial fluid within the reservoir of the dispenser 120 is ejected through the opening at the distal end 122 and into the internal chamber 118 of the intermediate portion 106. For example, the user may squeeze the body portion 126 of the dispenser 120 to eject the antimicrobial fluid into the internal chamber 118. The user may spray the cloth 130 with the desired amount of antimicrobial fluid by squeezing the dispenser 120. For example, the user may activate the dispenser 120 one or more times. The user can open the chamber 118, such as by opening the lid 105. The user can remove the cloth 130 from the internal chamber 118 of the intermediate portion 106. The user can use the cloth 130 to clean a surface (e.g., a shopping cart). After the user has cleaned the surface, the user can return the cloth 130 to the canister 102 to apply more antimicrobial fluid to it, such as by repeating one or more of the steps described above. Thus, the cloth 130 can be recharged. In various embodiments, after being recharged, the cloth 130 regains some or all of its potency and/or efficacy (e.g., compared to before it was used).

The cloth 130 can be used to disinfect numerous surfaces. For example, a user can use the cloth 130 to disinfect a shopping cart, the exterior of the canister 102 and/or dispenser 120, door handles, car doors, steering wheels, elevator buttons, tabletops, pens or other writing implements, shared items, etc. In some aspects, the cloth 130 can be used to disinfect a person's hands, like a napkin.

The dispenser 120 and the antimicrobial fluid within the dispenser 120 may come in different variations. For example, the antimicrobial fluid may come in different scents (e.g., citrus, vanilla, lavender, apple), the antimicrobial fluid may have different cleaning potencies, or the dispenser 120 may come in different sizes (e.g., 1 oz., 2 oz.). In some aspects, the dispenser 120 is configured to be replaceable or changeable such that a user can change the dispenser 120 based on a desired level of cleanliness, the active or inactive ingredients of the antimicrobial fluid, the scent of the antimicrobial fluid, an amount of antimicrobial fluid in the dispenser 120 or otherwise. For example, a user may carry the rechargeable antimicrobial wipe system 100 while outside the user's home. After spraying the cloth 130 in the canister 102 with the antimicrobial fluid, the user removes the cloth 130 from the canister 102 and the cloth 130 does not have the desired amount of antimicrobial fluid because the dispenser 120 was empty. The user can simply disconnect the empty dispenser 120 from the canister 102 and connect a full dispenser 120 to the canister 102. The user can reinsert the cloth 130, or insert a different cloth 130, into the canister 102 and apply the desired amount of antimicrobial fluid to the cloth 130.

Various sizes of the system 100 and its components are contemplated. As shown in FIGS. 3-4A, when a smaller dispenser 120 is connected to the canister 102, the total length $L_1$, $L_2$ of the rechargeable antimicrobial wipe system 100 can be about 6 inches. In some aspects, the total length $L_1$, $L_2$ of the rechargeable antimicrobial wipe system 100 can be about 1 inch to about 10 inches, about 3 inches to about 8 inches, or about 5 inches to about 6 inches. As shown in FIG. 4B, when a larger dispenser 120 is connected to the canister 102, the total length $L_4$ of the rechargeable antimicrobial wipe system 100 can be about 6.5 inches. In some aspects, the total length $L_4$ of the rechargeable antimicrobial wipe system 100 can be about 5 inches to about 12 inches, about 6 inches to about 11 inches, about 7 inches to about 10 inches, or about 8 inches to about 9 inches. Although specific lengths are described, other lengths of the system 100 are contemplated and are within the scope of the present invention.

Figure 5B:
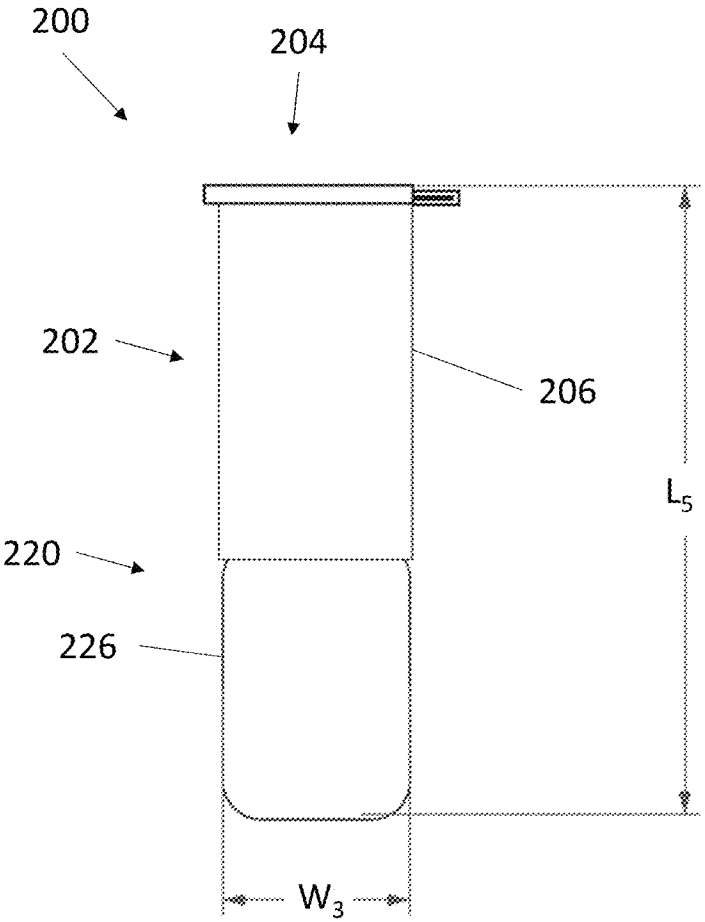
FIGS. 5A-5B show partial cross-sectional and side views of another embodiment of a rechargeable antimicrobial wipe system.
Figure 5A:
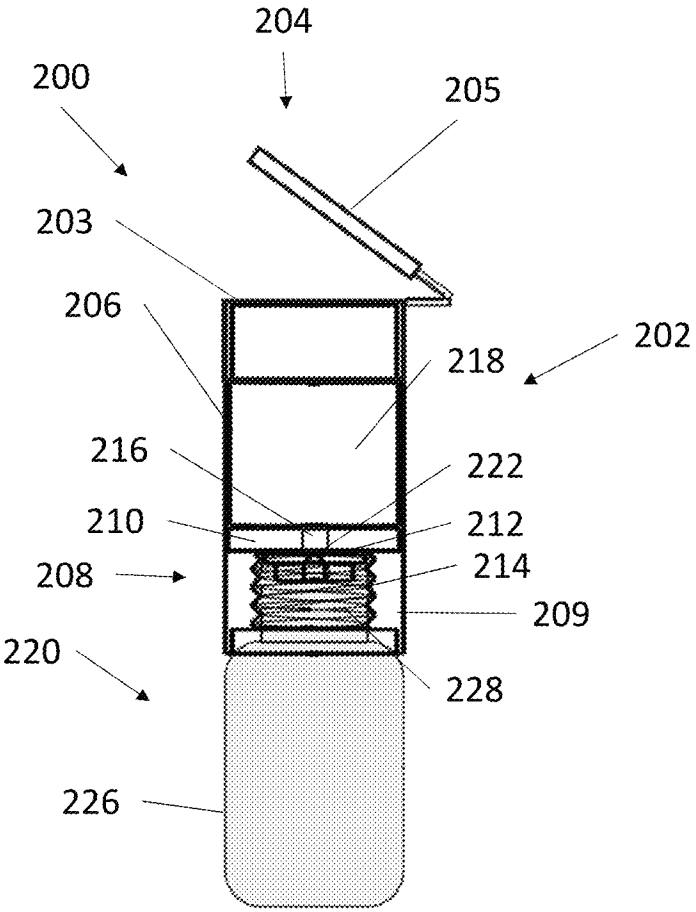

FIGS. 5A and 5B illustrate another embodiment of a rechargeable antimicrobial wipe system 200. The rechargeable antimicrobial wipe system 200 can be the same as or similar to the rechargeable antimicrobial wipe system 100 described with reference to FIGS. 1-4B. The system 200 can have any of the features of the system 100. Reference numerals of the same or substantially the same features may share the same last two digits.

FIG. 5A illustrates a partial cross-sectional view of the rechargeable antimicrobial wipe system 200 and FIG. 5B illustrates a side view of the rechargeable antimicrobial wipe system 200. The rechargeable antimicrobial wipe system 200 can include a fluid dispenser 220 and a canister 202. In certain implementations, the system 200 includes a cloth. The dispenser 220 can comprise a distal end 222 and a body portion 226. In some embodiments, the dispenser 220 comprises a threaded portion 228 extending between a proximal end of the body portion 226 and the distal end 222. In some aspects, the external diameter/width of the dispenser 220 can be about 1.2 inches. In some aspects, the external diameter/width can be about 0.5 inches to about 6 inches, about 1.5 inches to about 5 inches, or about 2.5 inches to about 4 inches. Although specific external diameters/widths are described, other external diameters/widths of the dispenser 220 are contemplated and are within the scope of the present invention.

The threaded adapter 209 of the canister 202 may comprise a threaded opening 214 that extends through at least a central portion of the length of the threaded adapter 209. The threaded opening 214 can be configured to engage with the threaded portion 228 of the dispenser 220 such that the distal end 222 of the dispenser 220 is sealed to the threaded adapter 209. In some embodiments, the threaded adapter 209 may comprise a wall 210 that separates the internal chamber 218 of the intermediate portion 206 from the other portions of the threaded adapter 209. The wall 210 may include an aperture 216 that generally aligns with the opening of the dispenser 226. In some embodiments, the threaded adapter 209 may comprise a plug insert 212 with an aperture. The plug insert 212 can be configured to engage with the distal end 222 of the dispenser 220.

Figure 6:
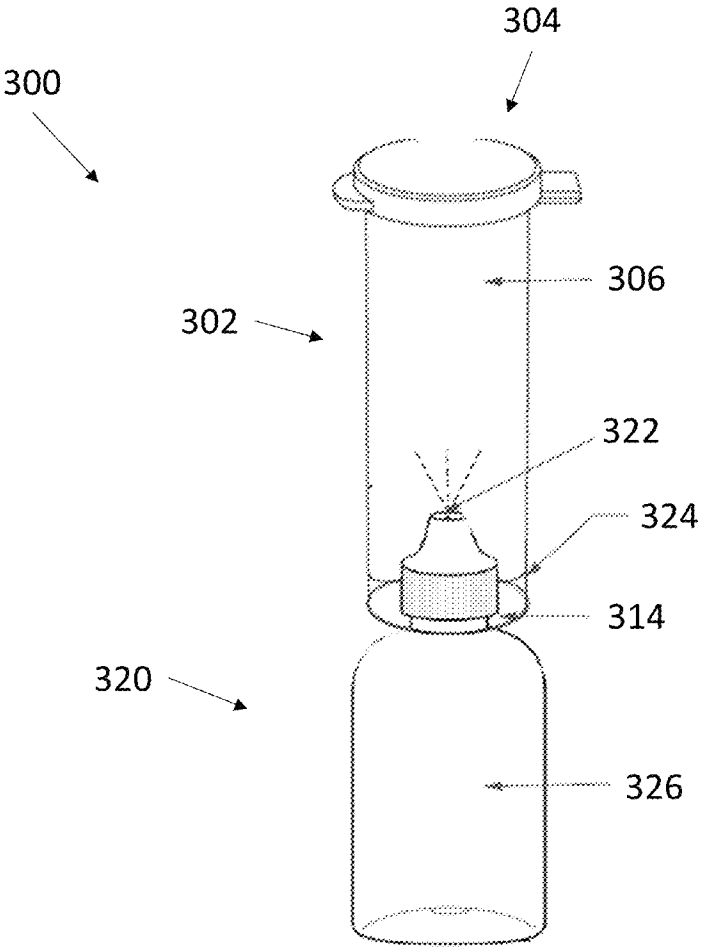
FIG. 6 shows a partial cross-sectional view of another embodiment of a rechargeable antimicrobial wipe system.

FIG. 6 illustrates another embodiment of a rechargeable antimicrobial wipe system 300. The rechargeable antimicrobial wipe system 300 can be the same as or similar to the systems 100, 200 described with reference to FIGS. 1-5B. The system 300 can have any of the features of the systems 100, 200. Reference numerals of the same or substantially the same features may share the same last two digits. As shown in FIG. 6, the canister 306 may comprise an opening 314 configured to receive the distal end 322 of the dispenser 320. In some embodiments, the dispenser 320 can be adhered to the canister 306 using a suitable adhesive 324 (e.g., epoxy adhesive). As illustrated with dashed lines, the dispenser 320 may be configured to introduce (e.g., mist, spray, squirt, or otherwise) the fluid into the canister 302.

The rechargeable antimicrobial wipe system 100, 200, 300 may be included in a kit. For example, the kit could include one or more cloths (e.g., 1, 2, 3, 4, 5, 6, 7, 8, 9, etc.), one or more dispensers 120, 220, 320 (e.g., 1, 2, 3, 4, 5, 6, 7, 8, 9, etc.), and at least one canister 102, 202, 302. The cloths can be the same or different. For example, the kit can have different cloths with different textures for different cleaning levels or different colors that can match a purse, outfit, or the like of the user. By having multiple cloths, the user can use a cloth for a day and use a different cloth the next day. Instead of disposing the first cloth, the user can wash the first cloth and use it again once it is clean, thereby limiting waste. The dispensers can be the same or different. For example, the kit can have different dispensers with different scents, potencies, antimicrobial properties, etc. Kits could come with any number of cloths, any number of dispensers 100, 200, 300 in different sizes and scents, and any number of canisters 102, 202, 302. The kit can be stored in a bag or carrying case.

The terms "first" and "second" are merely numbered for describing corresponding technical features clearly and do not represent the actual order. During particular implementations, the locations of the technical features defined by the terms "first" and "second" are interchangeable.

Terms of orientation used herein, such as "proximal," "distal," "intermediate," "top," "bottom," "horizontal," "vertical," "longitudinal," "lateral," "outer," "inner," and "end" are used in the context of the illustrated embodiment. However, the present disclosure should not be limited to the illustrated orientation. Indeed, other orientations are possible and are within the scope of this disclosure. Terms relating to circular shapes as used herein, such as "diameter" or "radius," should be understood not to require perfect circular structures, but rather should be applied to any suitable structure with a cross-sectional region that can be measured from side-to-side. Terms relating to shapes generally, such as "circular" or "cylindrical" or "semi-circular" or "semi cylindrical" or any related or similar terms, are not required to conform strictly to the mathematical definitions of circles or cylinders or other structures, but can encompass structures that are reasonably close approximations.

The terms "approximately," "about" and "substantially" as used herein represent an amount close to the stated amount that still performs a desired function or achieves a desired result. For example, in some embodiments, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

Conditional language, such as "can," "could," "might," or "may," unless specifically stated otherwise or otherwise understood within the context as used, is generally intended to convey that certain embodiments include or do not include, certain features, elements and/or steps. Thus, such conditional language is not generally intended to imply that features, elements and/or steps are in any way required for one or more embodiments.

Conjunctive language, such as the phrase "at least one of X, Y and Z," unless specifically stated otherwise, is otherwise understood with the context as used in general to convey that an item, term, etc. may be either X, Y or Z. Thus, such conjunctive language is not generally intended to imply that certain embodiments require the presence of at least one of X, at least one of Y and at least one of Z.

Some embodiments have been described in connection with the accompanying drawings. The figures are drawn to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed and/or rearranged. Further, the disclosure herein of any particular feature, aspect, method, property, characteristic, quality, attribute, element or the like in connection with various embodiments can be used in all other embodiments set forth herein. Additionally, any methods described herein may be practiced using any device suitable for performing the recited steps.

Various rechargeable antimicrobial wipe systems and related methods have been described and illustrated. Although this invention has been disclosed in the context of certain embodiments and examples, the scope of this disclosure extends beyond the specifically disclosed embodiments to other alternative embodiments and/or uses of the invention and obvious modifications and equivalents thereof. Any system, method, and device described in this application can include any combination of the preceding features described in this and other paragraphs, among other features and combinations described herein, including features and combinations described in subsequent paragraphs. While several variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. Various features and aspects of the disclosed embodiments can be combined with or substituted for, one another in order to form varying modes of the disclosed invention. Thus, it is intended that the scope of the present invention herein disclosed should not be limited by the particular disclosed embodiments described above, but should be determined only by a fair reading of the claims that follow.

The following is claimed:

1. A rechargeable antimicrobial wipe system comprising:
a reusable cloth configured to receive antimicrobial fluid;
a canister comprising a distal end, a proximal end, and an intermediate portion,
wherein the distal end of the canister comprises an access opening and a lid that is configured to be opened and closed,
wherein the proximal end of the canister comprises an opening through the proximal end, and
wherein the intermediate portion of the canister comprises an internal chamber configured to receive the cloth; and
a dispenser configured to deliver antimicrobial fluid into the internal chamber of the canister, wherein the dispenser comprises a distal portion, and a body portion,
wherein the distal portion of the dispenser comprises an opening, and wherein the distal portion of the dispenser is configured to engage with the opening of the proximal end of the canister, and
wherein the body portion of the dispenser comprises a reservoir of the antimicrobial fluid.

2. The system of claim 1, wherein the fluid comprises a sanitizing fluid.

3. The system of claim 1, wherein the cloth comprises a fibrous material.

4. The system of claim 1, wherein the access opening of the canister comprises a threaded portion on an external face of the access opening.

5. The system of claim 4, wherein the lid comprises a threaded portion on an internal face.

6. The system of claim 5, wherein the threaded portion of the access opening of the canister is configured to engage with the threaded portion of the lid such that the lid seals the access opening of the canister.

7. The system of claim 1, wherein the lid comprises a flip cap.

8. The system of claim 1, wherein the dispenser further comprises an aerolizer or a propellant.

9. The system of claim 1, wherein the internal chamber comprises a generally cylindrical shape.

10. The system of claim 1, wherein the proximal end of the canister further comprises a threaded adapter, and wherein the distal portion of the dispenser is configured to mate with the threaded adapter.

11. The system of claim 1, further comprising a pump mechanism configured to pump the antimicrobial fluid from the reservoir of the body portion of the dispenser through the opening of the distal portion of the dispenser and into the internal chamber of the canister.

12. A kit comprising the system of claim 1 and a plurality of the reusable cloth.

13. An apparatus for delivering antimicrobial fluid to a reusable cloth, the apparatus comprising:
a canister comprising a distal end, a proximal end, and an intermediate portion,
wherein the distal end of the canister comprises an access opening and a lid that is configured to be opened and closed, wherein the access opening is configured to allow the cloth to pass thorough the access opening,
wherein the proximal end of the canister comprises threads and an opening extending through the proximal end, and
wherein the intermediate portion of the canister comprises an internal chamber configured to receive the cloth and the antimicrobial fluid; and
a dispenser comprising a distal portion and a body portion, wherein the dispenser is configured to deliver the antimicrobial fluid to the internal chamber of the canister,
wherein the distal portion of the dispenser comprises an opening and a threaded portion, wherein the opening of the dispenser is configured to deliver the antimicrobial fluid to the internal chamber of the canister, wherein the threaded portion of the dispenser is configured to engage with the threads and opening of the proximal end of the canister such that the distal portion of the dispenser is secured to the proximal end of the canister, and
wherein the body portion of the dispenser comprises a reservoir of the antimicrobial fluid, wherein the body portion comprises a flexible sidewall, the body portion being configured to eject the antimicrobial fluid through the opening of the dispenser and into the internal chamber of the canister when a user squeezes the flexible sidewall of the dispenser.

14. The apparatus of claim 13, wherein the access opening of the canister comprises a threaded portion on an external face of the access opening.

15. The apparatus of claim 14, wherein the lid comprises a threaded portion on an internal face.

16. The apparatus of claim 15, wherein the threaded portion of the access opening of the canister is configured to engage with the threaded portion of the lid such that the lid seals the access opening of the canister.

17. The apparatus of claim 13, wherein the lid comprises a flip cap.

18. The apparatus of claim 13, wherein the dispenser comprises an aerolizer or a propellant.

19. The apparatus of claim 13, wherein the canister comprise a generally cylindrical shape.

20. The apparatus of claim 13, further comprising one or more of the reusable cloth.

* * * * *